United States Patent [19]

Owen et al.

[11] Patent Number: 4,786,318

[45] Date of Patent: Nov. 22, 1988

[54] THICKENING OF GOLD PROCESS SLURRIES

[75] Inventors: David O. Owen, Aurora; Lawrence J. Connelly, Oak Lawn, both of Ill.

[73] Assignee: Nalco Chemical Company, Naperville, Ill.

[21] Appl. No.: 89,710

[22] Filed: Aug. 26, 1987

Related U.S. Application Data

[63] Continuation of Ser. No. 895,980, Aug. 14, 1986, abandoned.

[51] Int. Cl.[4] ..... C22B 7/00

[52] U.S. Cl. ..... 75/2; 75/105; 75/118 R; 423/26; 423/29; 210/734; 210/728

[58] Field of Search ..... 75/2, 118 R, 105; 423/26, 29; 210/734, 728; 523/336; 524/801

[56] References Cited

U.S. PATENT DOCUMENTS

| | | | |
|---|---|---|---|
| Re. 28,474 | 12/1983 | Anderson et al. | 523/336 |
| Re. 28,576 | 12/1983 | Anderson et al. | 523/336 |
| 3,203,968 | 8/1965 | Sebba | 423/26 |
| 3,284,393 | 11/1966 | Vanderhoff et al. | 524/801 |
| 3,339,730 | 9/1967 | Boutin et al. | 423/26 |
| 4,342,653 | 8/1982 | Halverson | 210/734 |

OTHER PUBLICATIONS

Search 1720: Sulfonate Polymers as Flocculants or Mineral Processing Agents.

Flocculants for Processing of Gold and Silver Ores--Chemical abs. #1588.

*Primary Examiner*—Robert L. Stoll

*Attorney, Agent, or Firm*—John G. Premo; Anthony L. Cupoli; Donald G. Epple

[57] ABSTRACT

A process for thickening gold ore slurries or slimes for gold purification which comprises adding to such gold ore slimes an effective amount of flocculant comprising a terpolymer containing 5–35 mole % 2-AMPS, 5–45 mole % sodium acrylate and 50–90 mole % acrylamide, said terpolymer having an RSV of at least 20.

1 Claim, No Drawings

THICKENING OF GOLD PROCESS SLURRIES

This is a continuation of co-pending application Ser. No. 895,980 filed on 8/14/86 now abandoned.

INTRODUCTION

There are several methods of treating gold ores by cyanidation. In one method an aqueous slurry of finely divided gold ore is treated with an alkaline cyanide compound which forms a gold cyanide complex which dissolves in the water phase. This leaves in a suspended state the finely divided tailings or gangue. These tailings or slimes are customarily thickened and removed by means of organic flocculants. In another method a slurry of finely divided gold ore and gangue is thickened using a flocculant, and then the cyanide is added to complex and solubilize the gold so that it may be purified.

For both methods, the same common flocculants are used. Common flocculants used for this purpose are such materials as high molecular weight acrylamide polymers which includes acrylamide homopolymers, acrylamide-sodium AMPS (AMPS is 2-acrylamido-2-methylpropane sulfonic acid) and sodium acrylate acrylamide copolymers.

While these various acrylamide-containing polymers have proven effective, it would be of benefit to the art if an improved flocculant for these gold slimes was available.

THE INVENTION

A process for thickening gold ore process slurries or slimes to facilitate the separation of gold from tailings which comprises adding to such gold ore slurries or slimes an effective amount of flocculant comprising a terpolymer containing 5–35 mole % 2-AMPS, 5–45 mole % sodium acrylate and 50–90 mole % acrylamide, said terpolymer having an RSV of at least 20.

The polymers of the invention were evaluated at three commercial gold mines. As will be shown in the Table, up to a 71% improvement in activity was obtained over conventional flocculants using the terpolymers of this invention.

The terpolymers of the invention should have an RSV of at least 20, Preferably, they have an RSV of at least 30 when optimum results are sought to be achieved. To achieve high RSV's, it is beneficial that the polymers be prepared by the so-called inverse emulsion polymerization technique which is described in U.S. Pat. Nos. 3,284,393, Re. 28,576, and Re. 28,474.

The polymers are effective when used to treat slimes at a dosage rate ranging between 5–25 ppm to 0.2–45 ppm in the slime.

The dosages used are dependent on plant conditions. Generally, 0.2 to 10 ppm has been found satisfactory. However, in some circumstances the range may be 5 to 25 or even 10 to 45 ppm.

DETERMINATION OF REPLACEMENT RATIO 1. 2% solutions of each of the flocculants were inverted in D.I. water with a cone drive mixer for latex flocculant.
2. The polymer solutions were diluted as specified in the Table to the indicated percent solution prior to testing. The diluted solutions were not aged more than 30 minutes during the entire evaluation.
3. Free settling of the thickener feed was obtained by diluting, if required, the thickener feed with D.I. water.
4. Thickener feed was fractioned into 500 ml cylinders by agitating the slurry in a 5 gallon pail and adding 250 ml of the slurry to each cylinder and then adding, in the reverse order, 250 additional ml of thickener feed.
5. The cylinders were then placed in a rack capable of holding four cylinders and inverted 3 to 5 times. The post diluted polymer solution was then added on top of the cylinder through a syringe and the cylinder was inverted several times. The static cylinder was then allowed to remain on the bench while the settling rates were measured between the 450 and 375 ml points.
6. The clarity of the liquor was observed and the settling rate recorded.
7. The Replacement Ratio in the Table was then determined using data from this procedure. Replacement Ratio is the weight of sample divided by the weight of standard (present flocculant used at the plant) needed to obtain identical settling rates.

DISCUSSION OF THE TABLES

There are three flocculants used in gold benefication processes today. These are nonionic copolymers (Composition No. 1) slightly anionic copolymers (Composition No. 3), and moderately anionic copolymers (Composition No. 2). The terms "slightly" and "moderate" refer to the mole percent of anionic mer units in a flocculant. Commercially, the above products have a variation in mole percent composition of less than 5%.

We have found that the terpolymers of our invention show dramatically improved performance on gold process slurries in recovery facilities which use nonionic and slightly anionic polymers.

We have found that in slurry from recovery facilities which use moderately anionic polymers, the terpolymers of our invention show an improvement over flocculents currently used in gold process recovery, although the improvement is not quite as dramatic as in the other two cases.

We are currently experimenting with sodium acrylate-acrylamide copolymers which have been used as flocculants in fields other than gold recovery processes. For some of these, the Replacement Ratio Test results are better than the three known gold recovery process flocculants and some are comparable to the terpolymers of this invention.

In the following tables, Gold Process Facility No. 1 used a slightly anionic flocculant, Gold Process Facilities No. 2 and No. 3 used a nonionic flocculant, and Gold Process Facility No. 4 used a moderately anionic flocculant.

TABLE I

| Composition | Composition (mole %) Sodium | | | | % | Replacement Ratio Gold Processing Plants | | | |
|---|---|---|---|---|---|---|---|---|---|
| No. | NaAMPS | Acrylate | Acrylamide | RSV* | Polymer | No. 1[1] | No. 2[1] | No. 3[2] | No. 4[2] |
| 1 | 0 | 0 | 100 | 22 | 27 | 1.2 | 1.0 | 1.0 | 2.86 |
| 2 | 0 | 30.7 | 69.3 | 33 | 29 | 1.1–0.8** | 0.42 | 0.54 | 1.0 |

TABLE I-continued

| Composition No. | Composition (mole %) Sodium NaAMPS | Acrylate | Acrylamide | RSV* | % Polymer | Replacement Ratio Gold Processing Plants No. 1[1] | No. 2[1] | No. 3[2] | No. 4[2] |
|---|---|---|---|---|---|---|---|---|---|
| 3 | 11 | 0 | 89 | 25 | 29 | 1.0 | 0.21 | 0.42 | 1.15 |
| 4 | 6.7 | 6.7 | 86.6 | 27 | 29 | 0.96 | | 0.44 | 1.06 |
| 5 | 6.7 | 26.7 | 66.6 | 39 | 29 | 0.76 | 0.40 | 0.36 | 0.82 |
| 6 | 12 | 33 | 55 | 30 | 29 | — | | 0.51 | 1.03 |
| 7 | 13.3 | 13.3 | 73.4 | 31 | 29 | 0.61 | 0.36 | 0.29 | 0.90 |
| 8 | 13.3 | 13.3 | 73.4 | 24 | 29 | 0.95 | | 0.36 | 0.94 |
| 9 | 16 | 16 | 68 | 21 | 29 | — | | 0.41 | |
| 10 | 20 | 20 | 60 | 21 | 29 | 1.2 | 0.85 | 0.64 | 1.49 |
| 11 | 25 | 25 | 50 | 22 | 29 | 1.04 | | 0.68 | |
| 12 | 26.7 | 6.7 | 66.6 | 20 | 29 | 0.93 | 0.46 | 0.38 | 1.3 |

[1]RR at 2 in/min settling rate and on actives basis
[2]RR at 1.5 in/min settling rate and on actives basis.
* RSV is the Reduced Specific Viscosity
** Actual Data Points

Having thus described our invention, we claim:

1. A process for thickening gold ore process slurries or slimes produced by cyanidation which comprises adding to such gold ore slurries or slimes an effective amount of flocculant comprising a terpolymer containing 6.7–13.3 mole % 2-AMPS, 6.7–13.3 mole % sodium acrylate and 73.4–86.6 mole % acrylamide, said terpolymer having an RSV of at least 20.

* * * * *